US007118408B2

(12) United States Patent
Kubo et al.

(10) Patent No.: US 7,118,408 B2
(45) Date of Patent: Oct. 10, 2006

(54) FLAT CABLE COUPLER AND ELECTRICAL CONNECTOR ASSEMBLY

(75) Inventors: Akira Kubo, Tokyo (JP); Isao Igarashi, Tokyo (JP); Masata Umehara, Tokyo (JP); Takashi Sekine, Kanagawa (JP)

(73) Assignee: Tyco Electronics AMP K.K., Kanagawa-ken (JP)

( * ) Notice: Subject to any disclaimer, the term of this patent is extended or adjusted under 35 U.S.C. 154(b) by 0 days.

(21) Appl. No.: 11/251,153

(22) Filed: Oct. 14, 2005

(65) Prior Publication Data

US 2006/0084316 A1 Apr. 20, 2006

(30) Foreign Application Priority Data

Oct. 14, 2004 (JP) ..... 2004-300607
Apr. 5, 2005 (JP) ..... 2005-108203
May 18, 2005 (JP) ..... 2005-145870

(51) Int. Cl.
*H01R 12/24* (2006.01)

(52) U.S. Cl. ..... 439/495

(58) Field of Classification Search ..... 439/495, 439/260–261

See application file for complete search history.

(56) References Cited

U.S. PATENT DOCUMENTS 5,813,877 A * 9/1998 Nakamura ..... 439/267
6,840,797 B1 * 1/2005 Ueda et al. ..... 439/495
6,948,973 B1 * 9/2005 Hsu et al. ..... 439/495

FOREIGN PATENT DOCUMENTS

JP 07-037654 2/1995
JP 11-329620 11/1999
JP 2000-268904 9/2000

* cited by examiner

*Primary Examiner*—Hae Moon Hyeon
(74) *Attorney, Agent, or Firm*—Barley Snyder LLC

(57) ABSTRACT

An electrical connector assembly comprises a flexible flat cable and a coupler. The flexible flat cable has a tip. A plurality of conductors is provided on a section of the tip between ends thereof. The coupler includes a first holding member mated with a second holding member. The flexible flat cable is positioned between the first and second holding members. The coupler is arranged behind the tip such that both sides of the tip are exposed. The coupler has a width longer than the section of the tip provided with the conductors.

15 Claims, 19 Drawing Sheets

FLAT CABLE COUPLER AND ELECTRICAL CONNECTOR ASSEMBLY

FIELD OF THE INVENTION

The invention relates to a coupler for a flexible flat cable (FFC) and an electrical connector assembly comprising the coupler, the FFC, and an electrical connector.

BACKGROUND OF THE INVENTION

An FFC typically has a film-like flexibility and is provided with a plurality of conductors (see Japanese Patent Application Publication No. 7-37654). The FFC is connected to an electrical connector, which is mounted on a substrate or the like. To connect the FFC to the electrical connector, a tip of the FFC is inserted into an FFC receiving opening in the electrical connector, which is provided with a plurality of contacts. Because the tip of the FFC is soft due to its flexibility, it is difficult to confirm whether the tip of the FFC is fully inserted into the electrical connector. This is problematic in that when the tip of the FFC is only partially inserted into the electrical connector, the electrical connector assembly can still pass a continuity test. This type of electrical connection, however, is likely to become disconnected when the electrical connector and/or the FFC is subjected to vibrations or impacts during shipment. In addition, the partially inserted FFC is prone to crosswise insertion relative to the electrical connector, which can cause faulty electrical connections between the FFC and the electrical connector. Further, after the tip of the FFC is fully inserted into the electrical connector, if the FFC is extracted by a force exerted only on one end of the FFC in a direction of width, a faulty electrical connection can occur.

In order to solve the above-identified problems, it has been proposed that a coupler be attached to the FFC before the tip of the FFC is inserted into the electrical connector (see Japanese Patent Application Publication Nos. 11-329620 and 2000-268904). In the above examples, the tip of the FFC is strengthened by providing a rigid member across the FFC that enables the operator to recognize when the tip of the FFC is completely inserted into the electrical connector. Additionally, the presence of the coupler prevents crosswise insertion of the FFC into the electrical connector.

In these examples, however, the portion of the FFC which is supported by the rigid member is thicker because of the presence of the rigid member. Thus, in order for the FFC to be received in the electrical connector, the FFC receiving opening must be formed with an increased height. Increasing the height of the FFC receiving opening, however, causes the electrical connector to have a greater overall height, which is contrary to the current demand for electrical connectors with decreased heights and smaller mounting areas.

BRIEF SUMMARY OF THE INVENTION

It is therefore an object of the invention to provide a coupler and an electrical connector assembly comprising a coupler, a FFC, and an electrical connector wherein the coupler mated with the FFC can be accommodated in the electrical connector without having to increase the height and/or the mounting area of the electrical connector and can prevent faulty electrical connections between the FFC and the electrical connector.

This and other objects are achieved by a coupler for inserting a tip of a flexible flat cable into an electrical connector. The tip of the flexible flat cable is provided with a plurality of conductors between ends thereof for electrically connecting the flexible flat cable to contacts in the electrical connector. The coupler comprises first and second holding members. The first and second holding members form a gap for receiving a portion of the flexible flat cable behind the tip there between when mated with each other such that both sides of the tip are exposed. A lock arm extends from the coupler for engaging with a corresponding engagement member on the electrical connector.

This and other objects are further achieved by an electrical connector assembly comprising a flexible flat cable and a coupler. The flexible flat cable has a tip. A plurality of conductors is provided on a section of the tip between ends thereof. The coupler includes a first holding member mated with a second holding member. The flexible flat cable is positioned between the first and second holding members. The coupler is arranged behind the tip such that both sides of the tip are exposed. The coupler has a width longer than the section of the tip provided with the conductors.

DETAILED DESCRIPTION OF THE INVENTION

Figure 1:
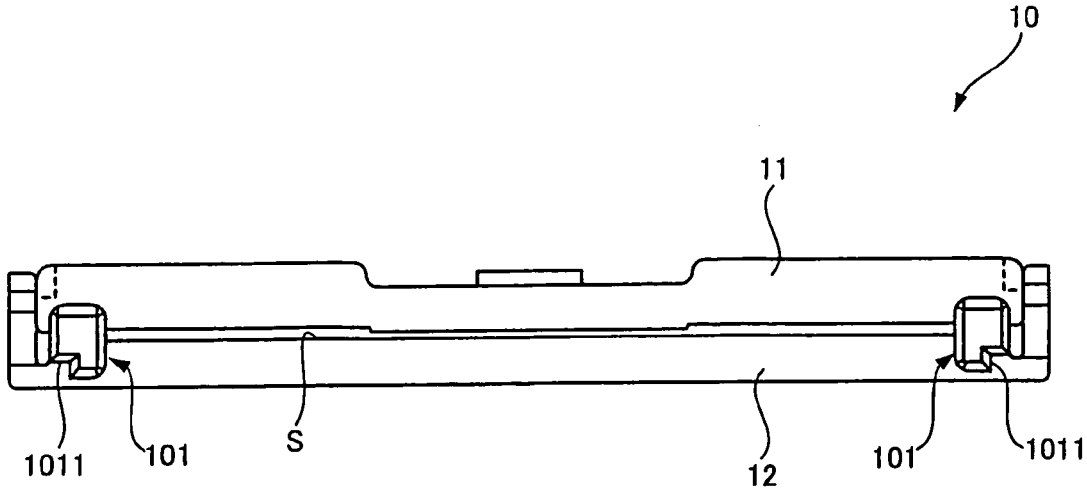
FIG. 1 is a side view of a coupler according to a first embodiment of the invention.
Figure 2:
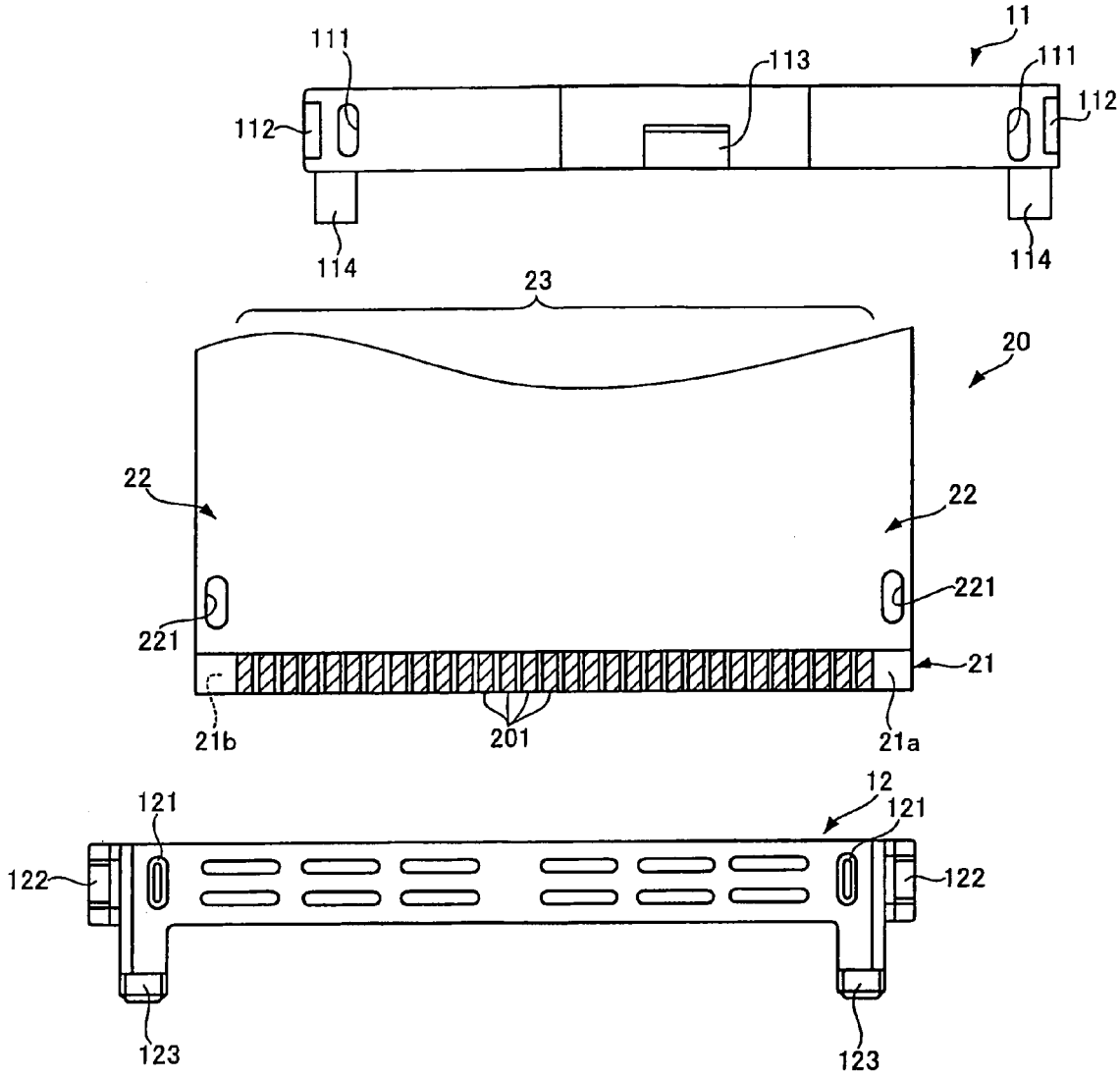
FIG. 2 is an exploded view of the coupler of FIG. 1 and an FFC according to a first embodiment of the invention before the coupler is mated with the FFC.
Figure 9:
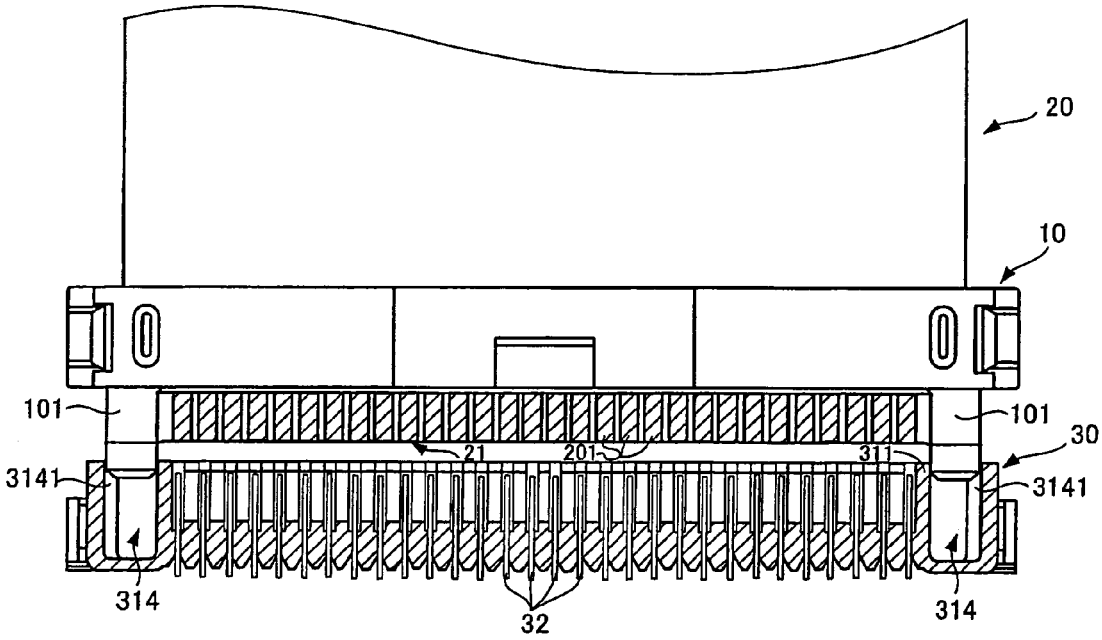
FIG. 9 is a partial plan view of the FFC of FIG. 2 fitted with the coupler of FIG. 1 and partially inserted into the electrical connector of FIG. 5.
Figure 10:
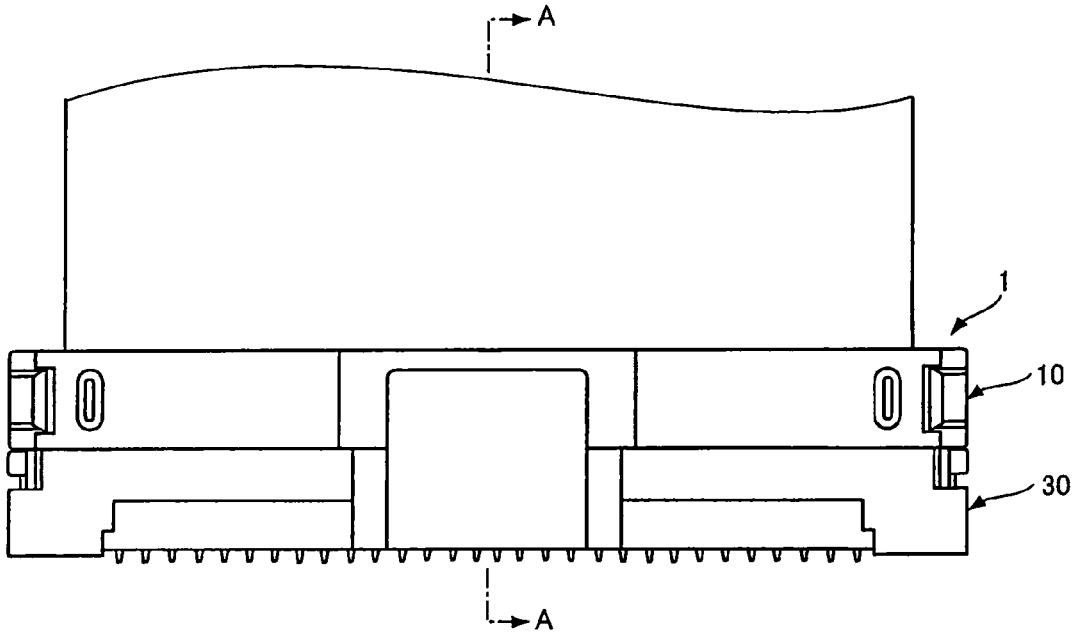
FIG. 10 is a partial plan view of the FFC of FIG. 2 fitted with the coupler of FIG. 1 and completely inserted into the electrical connector of FIG. 5.
Figure 11:
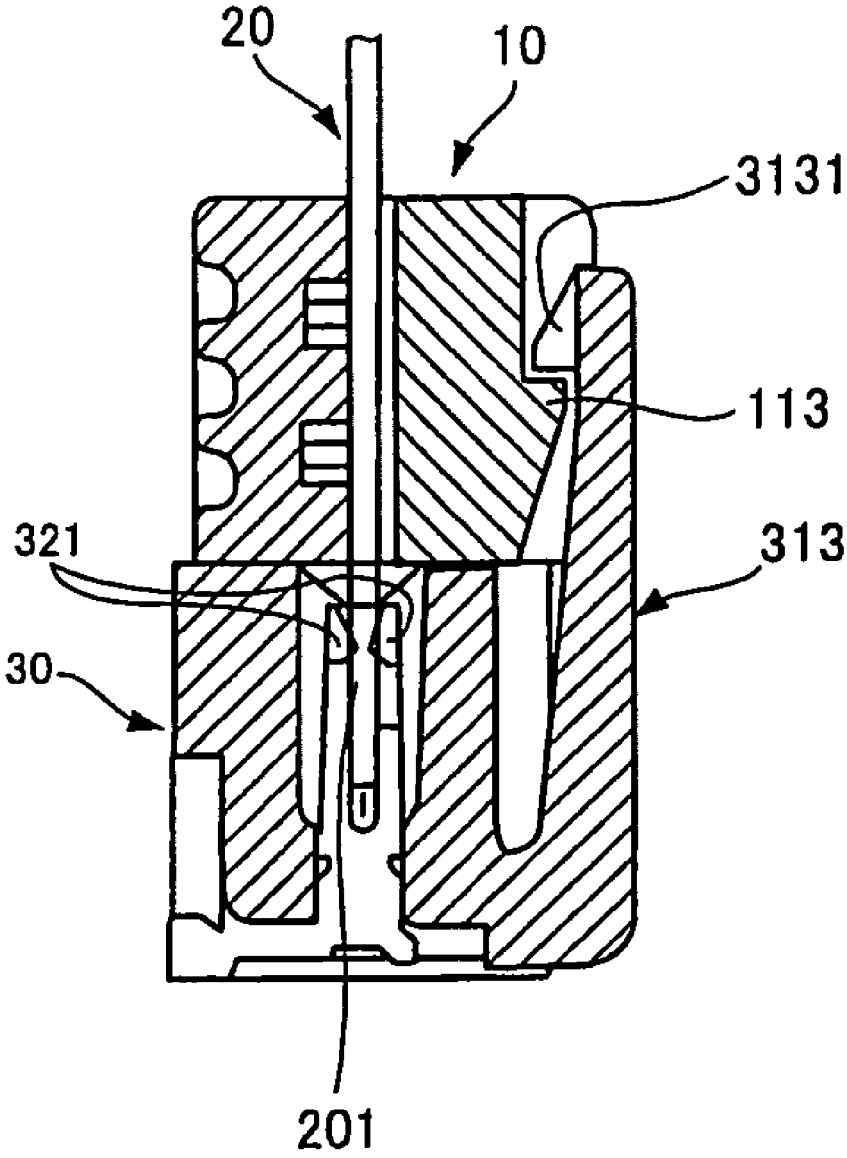
FIG. 11 is a sectional view along line A—A of FIG. 10.

FIGS. 1–11 show a coupler 10, an FFC 20, and an electrical connector 30 that comprise an electrical connector assembly according to a first embodiment of the invention. As shown in FIG. 1, the coupler 10 comprises first and second holding members 11, 12. As shown in FIG. 2, the first holding member 11 includes receiving apertures 111 at ends thereof. Adjacent to each of the receiving apertures 111 is an engaging groove 112. The first holding member 11 has a lock arm 113 at a central portion that ascends from an upper portion of the first holding member 11, as shown in FIG. 11. Protrusions 114 extend from the ends of the first holding member 11, as shown in FIG. 2. The second holding member 12 includes bosses 121 that correspond to the receiving apertures 111. Adjacent to each of the bosses 121 is an engaging arm 122. The engaging arms 122 extend forward and correspond to the engaging grooves 112. Protrusions 123 corresponding to the protrusions 114 of the first holding member 11 extend from ends of the second holding member 12. The first and second holding members 11, 12 made be formed, for example, from an insulating resin As shown in FIG. 1, when the first and second holding members 11, 12 are mated, a gap S exists there between. The gap S has a thickness substantially corresponding to the thickness of the FFC 20 (FIG. 2), which is to be received therein. Additionally, when the first and second holding members 11, 12 are mated, the protrusions 114, 123 of the first and second holding members are joined to form guide members 101 at each end of the coupler 10. Each of the guide members 101 includes a keyway 1011 formed at a lower portion thereof. The first and second holding members 11, 12 are formed to have a width longer than a width of a central portion 23 (FIG. 2) of the FFC 20.

The FFC 20 has a film-like flexibility and can be used, for example, for electrically connecting circuits between two different substrates. It will be appreciated by those skilled in the art that the FFC 20 could alternatively be a flexible printed cable (FPC) or the like. As shown in FIG. 2, a plurality of conductors 201 is arranged along a direction of width between ends 22 of the FFC 20. Although the conductors 201 are only shown as being arranged at a tip 21 of the FFC 20 in FIG. 2, the conductors 201 in actuality extend into the central portion 23 of the FFC 20. The tip 21 has a front side 21*a* and a back side 21*b*. An elongated slot 221 is provided on each of the ends 22 behind the tip 21. The elongated slot 221 may be formed, for example, by punching.

Figure 5:
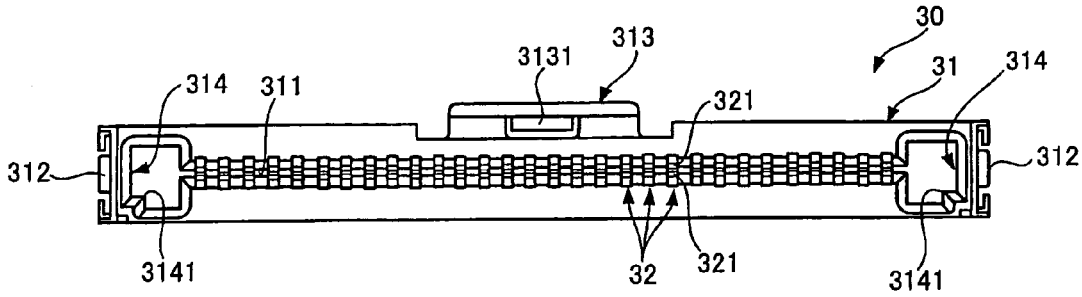
FIG. 5 is a front view of an electrical connector according to a first embodiment of the invention.
Figure 6:
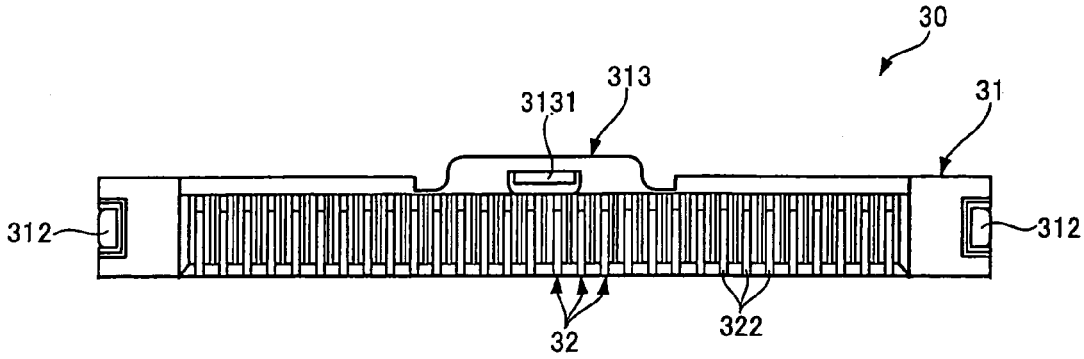
FIG. 6 is a back view of the electrical connector of FIG. 5.

FIGS. 5–8 show the electrical connector 30. The electrical connector 30 may be, for example, a surface-mount electrical connector. The electrical connector 30 includes a housing 31 provided with an FFC receiving opening 311. A plurality of contacts 32 are arranged in the FFC receiving opening 311 at a predetermined pitch along a direction of width of the housing 31. As shown in FIGS. 5–6, the contacts 32 have opposing arms 321 and tines 322. The tines 322 are soldered, for example, to a pad (not shown) on a substrate (not shown) so that the electrical connector 30 is electrically connected to the substrate (not shown).

Figure 7:
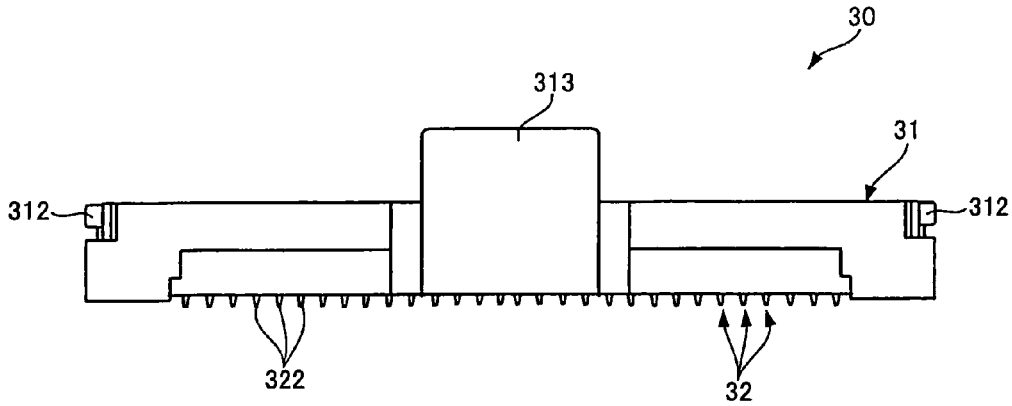
FIG. 7 is a plan view of the electrical connector of FIG. 5.
Figure 8:
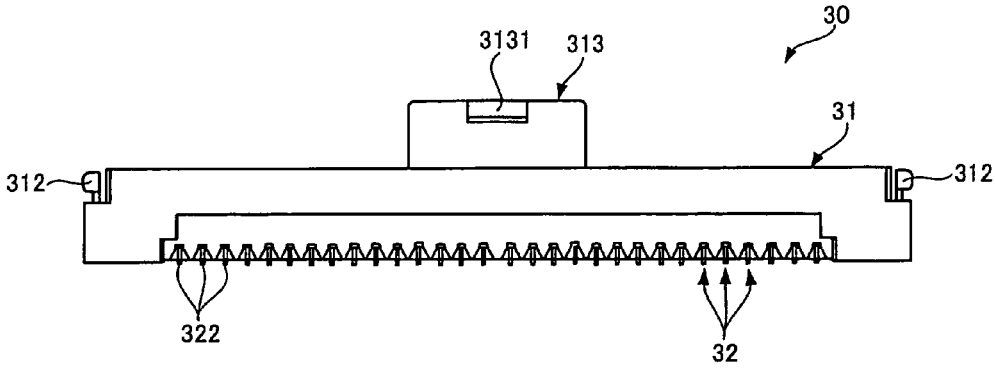
FIG. 8 is a bottom view of the electrical connector of FIG. 5.

Guide holes 314 are formed at each end of the FFC receiving opening 311 and communicate therewith. The guide holes 314 extend from a front to a back side of the housing 30. A key 3141 is formed in a wall defining each of the guide holes 314 at a lower portion thereof. The key 3141 extends in a direction of depth of the corresponding guide hole 314. Solder pegs 312 extend from ends of the housing 31. The solder pegs 312 are soldered, for example, to the substrate (not shown) so that the electrical connector 30 can be securely fixed to the substrate (not shown) when mounted thereon. As shown in FIGS. 7–8 and 11, an engagement member 313 is provided at a central portion of the housing 31 with respect to the direction of width. The engagement member 313 has an engaging claw 3131 that extends opposite to the substrate (not shown) when the electrical connector 30 is mounted thereon.

Figure 3:
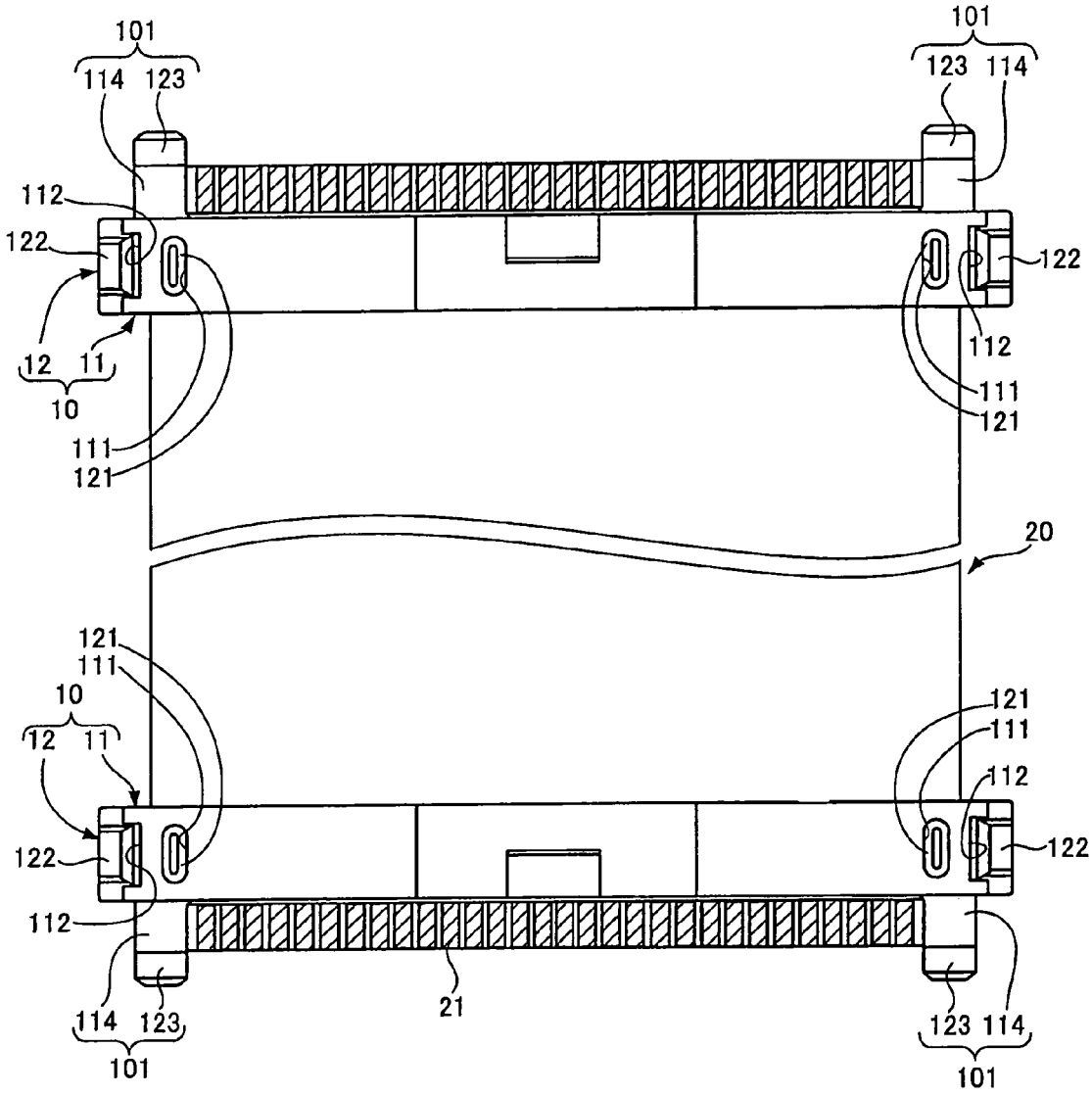
FIG. 3 is a plan view of the coupler of FIG. 1 mated with the FFC of FIG. 2.
Figure 4:
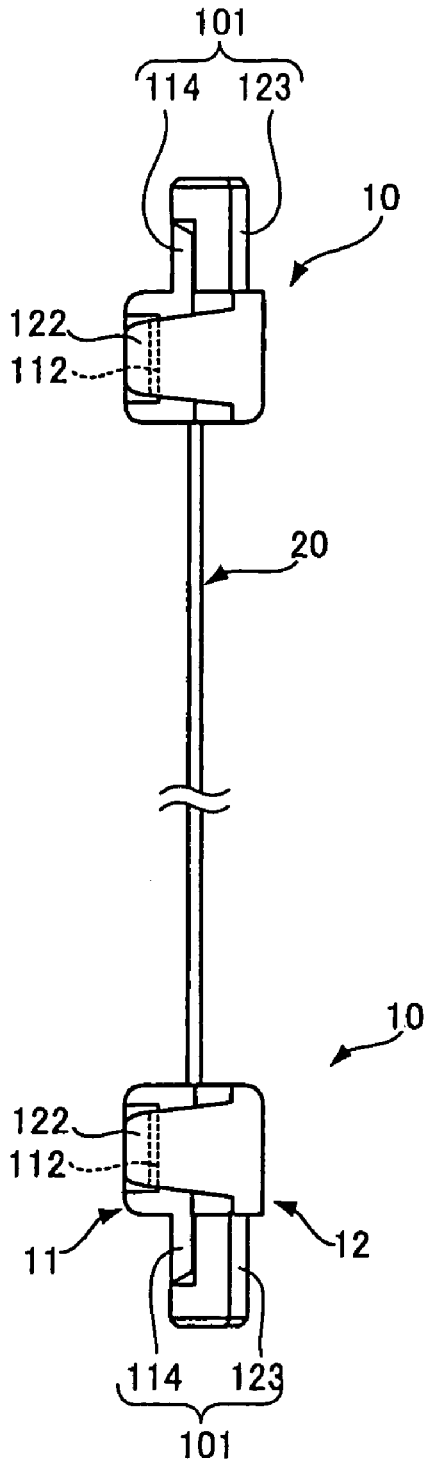
FIG. 4 is a side view of FIG. 3.

FIGS. 3–4 show the coupler 10 positioned on the front end and the rear end of the FFC 20. The FFC 20 is positioned between the first holding member 11 and the second holding member 12 of the couplers 10. As shown in FIG. 3, when the second holding member 12 is mated with the first holding member 11 the front side 21*a* and the back side 21*b* of the tip 21 is exposed. The engaging arms 122 of the second holding member 12 engage with the corresponding engaging grooves 112 of the first holding member 11. The bosses 121 of the second holding members 12 extend through the corresponding elongated slots 221 of the FFC 20 and engage with the corresponding receiving apertures 111 of the first holding member 11. Tension is thereby applied to the FFC 20 along the direction of width to strengthen the rigidity of the FFC 20 and to ensure the positioning of the FFC 20 in the direction of width with respect to the electrical connector 30.

FIG. 9 shows the FFC 20 fitted with the coupler 10 inserted halfway into the electrical connector 30. To insert the FFC 20 fitted with the coupler 10 into the FFC receiving opening 311 of the electrical connector 30, the keyways 1011 (FIG. 1) on the guide members 101 are first aligned with the corresponding keys 3141 of the electrical connector 30. The guide members 101, which protrude beyond the tip 21 of the FFC 20, are then inserted into the corresponding guide holes 314 of the electrical connector 30. The tip 21 of the FFC 20, which is guided by the guide members 101, is then inserted into the FFC receiving opening 311 of the electrical connector 30. As the tip 21 of the FFC 20 is inserted into the FFC receiving opening 311 of the electrical connector 30, the ends 22 of the FFC 20 are received in the guide holes 314 of the electrical connector 30.

As the FFC 20 is guided by the guide members 101 into the electrical connector 30, the tip 21 of the FFC 20 is held substantially parallel to the electrical connector 30 to prevent any gaps in the pitch between the conductors 201 of the FFC 20 and the contacts 32 of the electrical connector 30. The guide members 101 additionally prevent crosswise insertion of the FFC 20 into the electrical connector 30 thereby preventing short circuiting of the contacts 32 by the conductors 201 of the FFC 20. The keyways 1011 also make the guide member 101 vertically asymmetrical so that reverse insertion of the coupler 10 into the electrical connector 30 is prevented.

FIG. 10–11 show the FFC 20 fitted with the coupler 10 completely inserted into the electrical connector 30. When the FFC 20 is completely inserted into the electrical connector 30, each of conductors 201 of the FFC 20 is pinched by the arms 321 of the contacts 32 to electrically connect the FFC 20 to the electrical connector 30. Additionally, the lock arm 113 of the coupler 10 engages with the engaging claw 3131 formed on the engagement member 313 of the electrical connector 30. This engagement generates a click that enables an operator (not shown) to feel that the FFC 20 is fully inserted into the electrical connector 30. Consequently, failure of insertion, partial insertion, or crosswise insertion of the FFC 20 into the electrical connector 30 can be prevented. Even if the FFC 20 is extracted by a force exerted only on one of the ends 22 of the FFC 20, the FFC 20 can be prevented from crosswise removal relative to the electrical connector 30 because the coupler 10 is engaged with the electrical connector 30.

In the coupler 10 according to the first embodiment of the invention, because the tip 21 of the FFC 20 fitted with the coupler 10 is not positioned between the first and second holding members 11, 12 but is exposed, the thickness of the FFC receiving opening 311 in the electrical connector 30 is determined solely by the thickness of the FCC 20. The electrical connector 30 can therefore have a decreased height and smaller mounting area.

Figure 12:
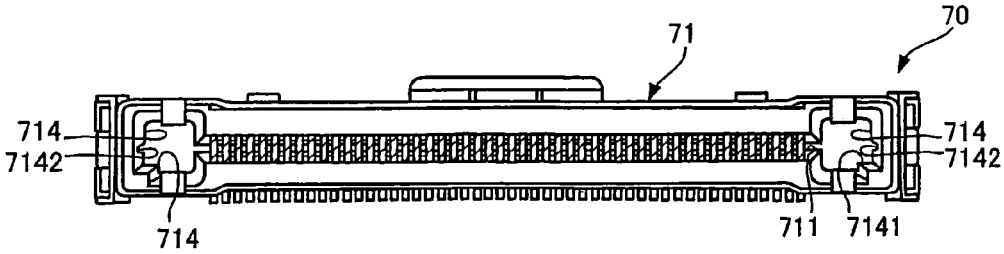
FIG. 12 is a front view of an electrical connector according to a second embodiment of the invention.
Figure 13:
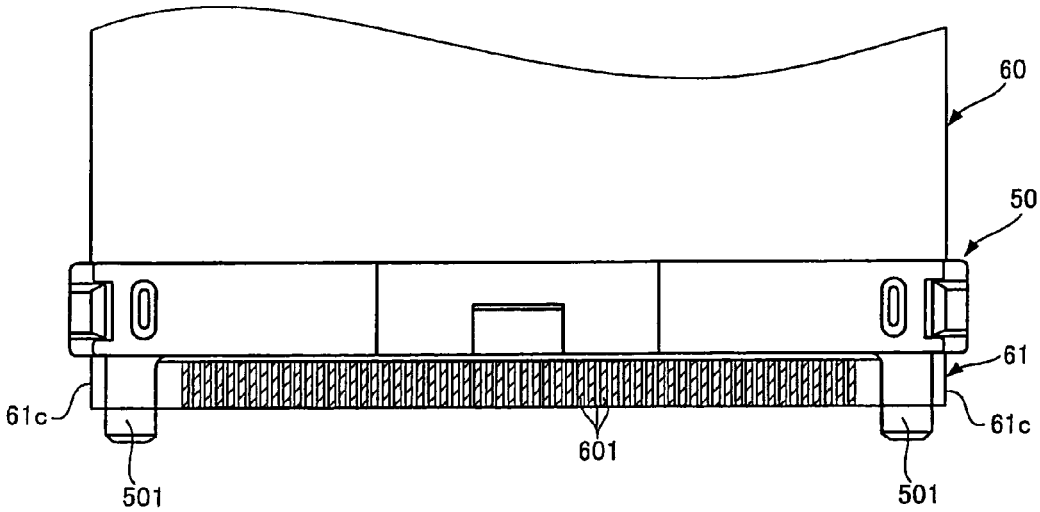
FIG. 13 is a partial plan view of an FFC according to a second embodiment of the invention fitted with a coupler according to a second embodiment of the invention.

FIGS. 12–13 show a coupler 50, an FFC 60, and an electrical connector 70 that comprise an electrical connector assembly according to a second embodiment of the invention. Elements of the second embodiment that are identical to elements of the first embodiment will not be described further herein. As shown in FIG. 12, the electrical connector 70 includes a housing 71 provided with an FFC receiving opening 711. Guide holes 714 are formed at each end of the FFC receiving opening 711 and communicate therewith. A key 7141 is formed in a wall defining each of the guide holes 714 at a lower portion thereof. Each of the guide holes 714 has a positioning groove 7142 sunken toward an outside of the housing 71 with respect to a direction of width.

As shown in FIG. 13, the FFC 60 is provided with a plurality of conductors 601. The conductors 601 are arranged along a direction of width between ends 61*c* of the tip 61 of the FFC 60 and have a pre-determined pitch smaller than the conductors 201 of the first embodiment (a narrower space between centerlines of the adjacent conductors 601). The FFC 60 therefore requires more precise positioning in the direction of width to properly engage with the contacts of the electrical connector 70 than the FFC 20 of the first embodiment.

As shown in FIG. 13, the coupler 50 includes first and second holding members. Guide members 501 extend from ends of the first and second holding members. The coupler 50 has a width longer than the width from the end 61*c* to the end 61*c* of the FFC 60. The distance between the guide members 501 however is smaller than the width from the end 61*c* to the end 61*c* of the FFC 60. When the coupler 50 is positioned on the front and rear ends of the FFC 60, the FFC 60 is positioned between the first and second holding members such that the tip 61 is exposed.

In the electrical connector assembly according to the second embodiment, when the FFC 60 fitted with the coupler 50 is inserted into the electrical connector 70, each of the ends 61*c* of the tip 61 is received in the corresponding positioning groove 7142 of the electrical connector 70. Movement of the FFC 60 in the direction of width is thereby limited to ensure precise positioning of the FFC 60 with respective to the direction of width relative to the electrical connector 70. As a result, proper engagement of the contacts of the electrical connector 70 with the conductors 601 is ensured.

Figure 14:
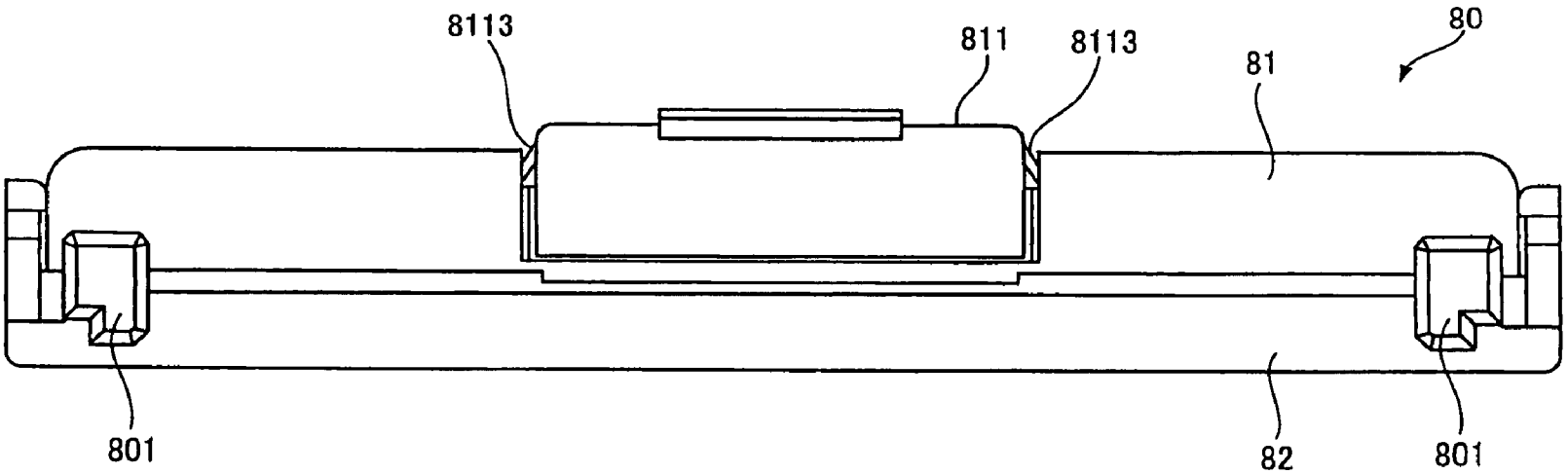
FIG. 14 is a front view of a coupler according to a third embodiment of the invention.
Figure 15:
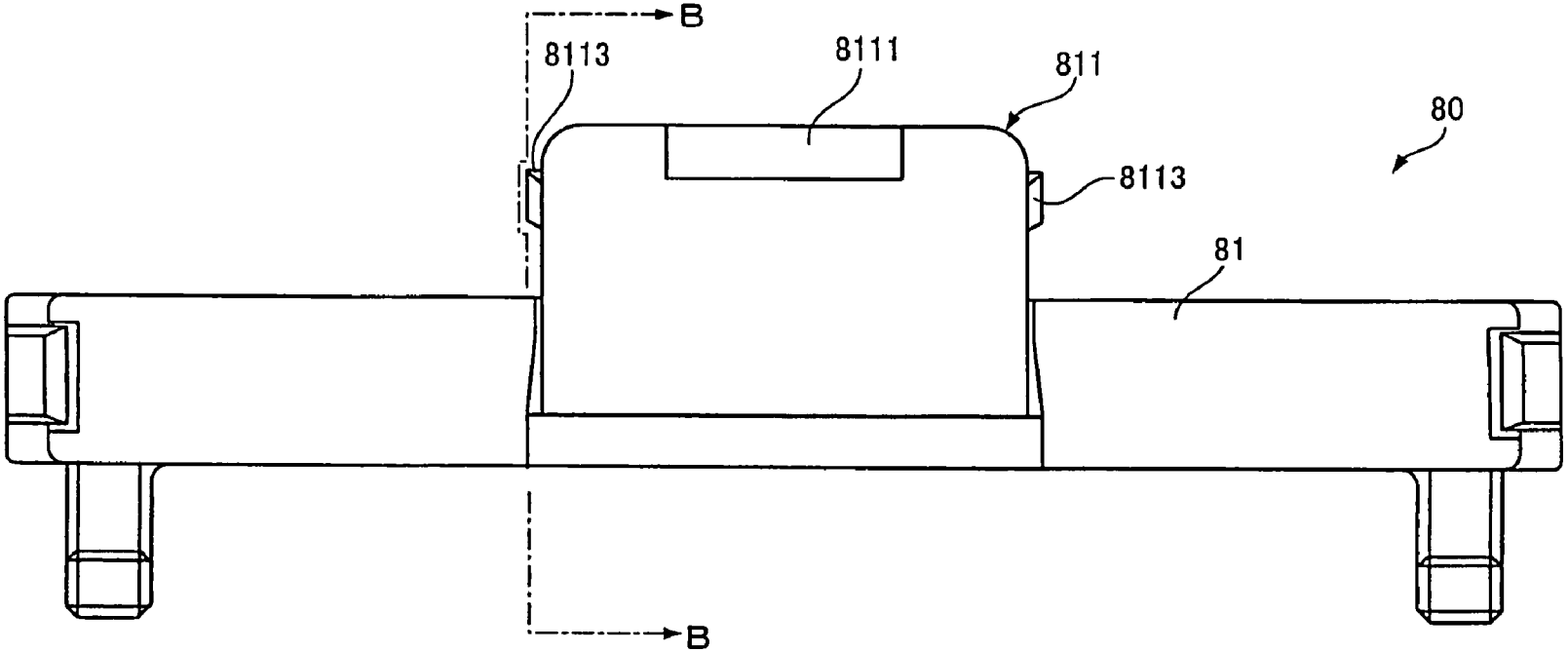
FIG. 15 is a plane view of the coupler of FIG. 14.
Figure 16:
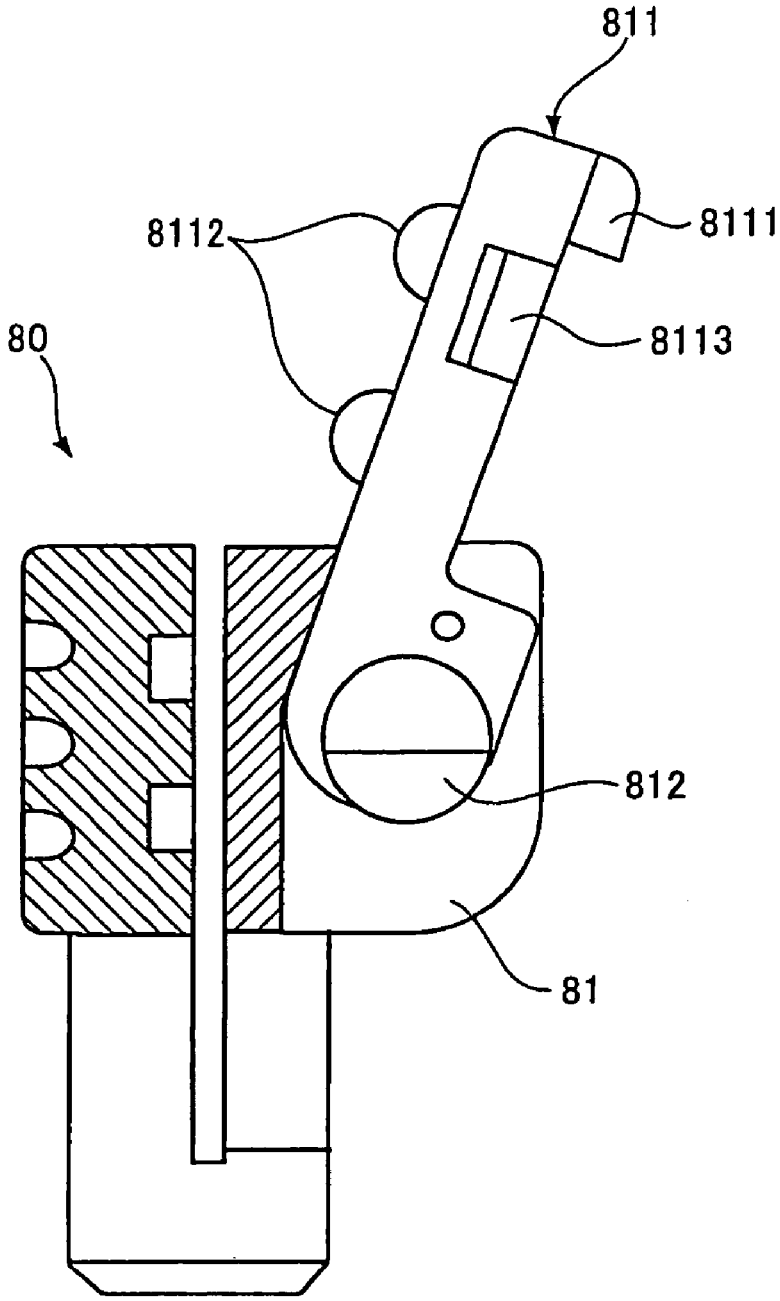
FIG. 16 is a sectional view along line B—B of FIG. 15.
Figure 17:
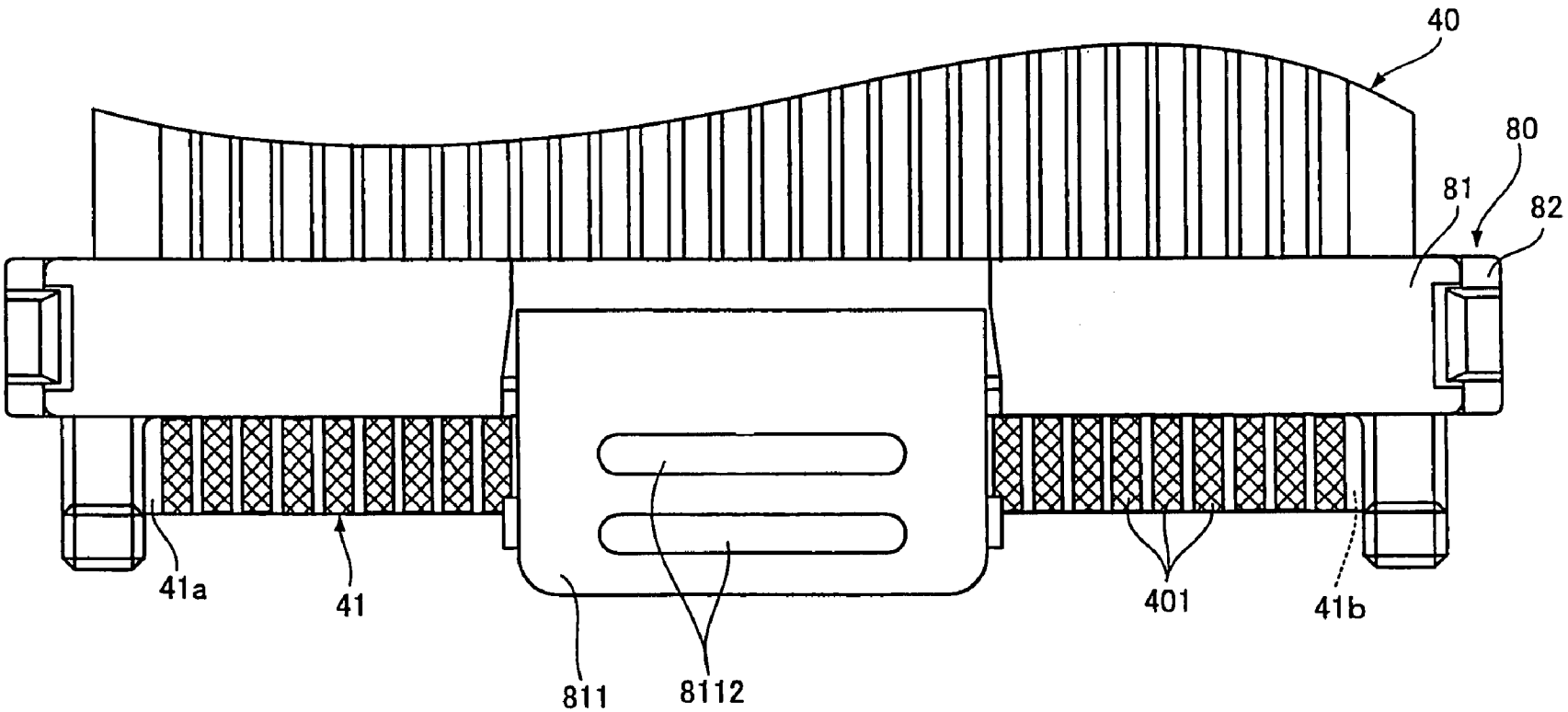
FIG. 17 is a partial plan view of an FFC according to a third embodiment of the invention fitted with the coupler of FIG. 14.
Figure 18:
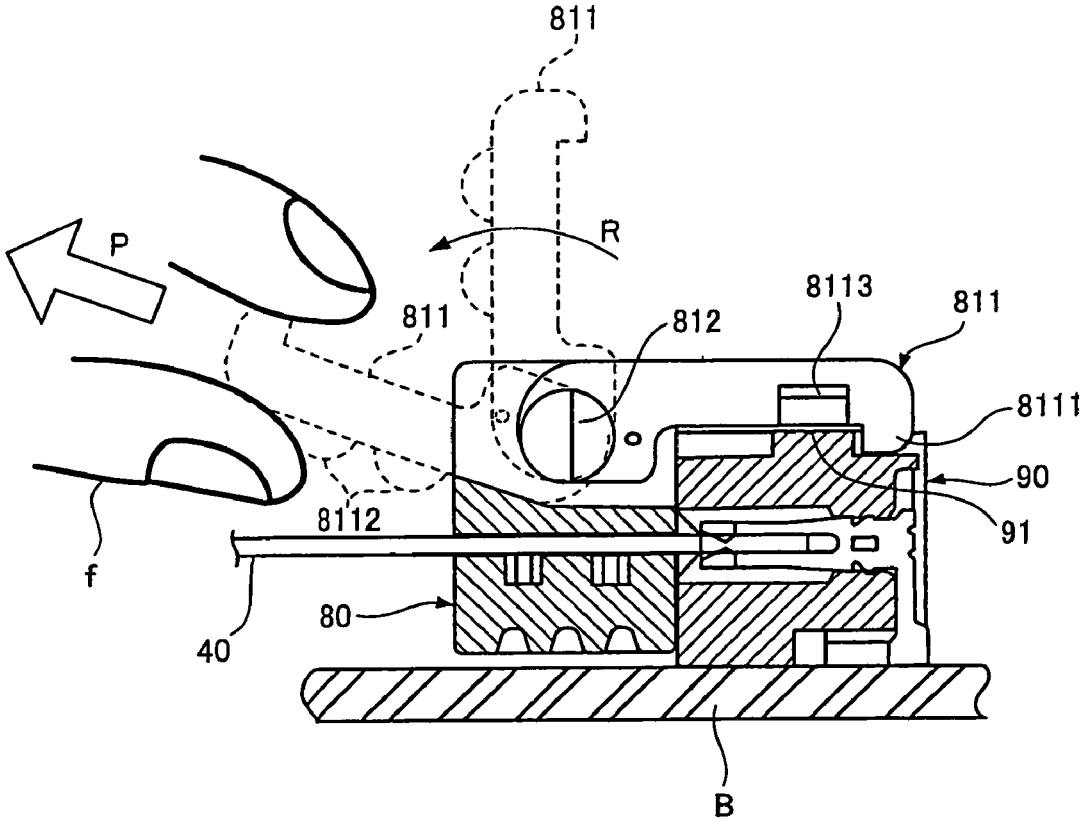
FIG. 18 is a partial plan view of the FFC of FIG. 17 fitted with the coupler of FIG. 14 and completely inserted into an electrical connector according to a third embodiment of the invention.

FIGS. 14–18 show a coupler 80, an FFC 40, and an electrical connector 90 according to a third embodiment of the invention. Elements of the third embodiment that are identical to elements of the first embodiment will not be described further herein. As shown in FIGS. 14–15, the coupler 80 includes first and second holding members 81, 82. Guide members 801 formed when the first and second holding members 81, 82 are mated extend from ends of the coupler 80. A lock arm 811 is attached to the first housing member 81 by, for example, a hinge 812, which extends along a direction of width of the second holding member 81, as shown in FIG. 16. The lock arm 811 is attached to the first housing 81 such that it can rotate between an open position and a closed position and can stop at any position there between. FIGS. 14–16, and the phantom lines in FIG. 18 show the lock arm 811 in the open position. FIG. 17 and the solid lines in FIG. 18 show the lock arm 811 in the closed position. The lock arm 811 replaces the lock arm 113 on the first housing member 11 of the first embodiment. A locking claw 8111 extends from a rear end of the lock arm 811 and corresponds to an engagement member 91 (FIG. 18) formed on the electrical connector 90. The engagement member 91 replaces the engagement member 313 formed on the electrical connector 30 of the first embodiment. Operator finger holds 8112 extend from a front side of the lock arm 811. Protrusions 8113 are formed at each end of the lock arm 811 in the direction of width.

As shown in FIG. 17, the FFC 40 is provided with a plurality of conductors 401. The conductors 401 are arranged along a direction of width between ends of a tip 41 of the FFC 40. The tip 41 has a front side 41*a* and a back side 41*b*. The coupler 81 has a width longer than the width of the FFC 40. When the coupler 81 is positioned on the front and rear ends of the FFC 40, the FFC 40 is positioned between the first and second holding members 81, 82 such that the tip 61 is exposed.

In order to insert the FFC 40 fitted with the coupler 80 into the electrical connector 90 mounted on substrate B, the lock arm 811 is positioned at the open position so that each of the guide members 801 fits into the guide holes (not shown) of the electrical connector 90, as shown in FIG. 18. When the FFC 40 is fully inserted into the electrical connector 90, the lock arm 811 is rotated to the closed position. When the lock arm 811 reaches the closed position, the locking claw 8111 engages the engagement member 91 of the electrical connector 90 and a click can be felt by the operator's fingers f by the engagement of the protrusion 8113. If the FFC 40 is not fully inserted into the electrical connector 90, the locking claw 8111 can not engage the engagement member 91 and a click will not be generated by the engagement of the protrusion 8113. In the closed position, the lock arm 811 extends beyond the first and second holding members 81, 82 toward the tip 41 of the FFC 40.

In order to remove the FFC 40 from the electrical connector 90, the lock arm 811 is rotated in a direction of arrow R from the closed position to release the engagement of the locking claw 8111 with the engagement member 91. The lock arm 811 is rotated to its maximum angle and is pulled in a direction of arrow P. At this position, the end of the lock arm 811 is facing almost the same direction as the direction by which the FFC 40 will be removed from the electrical connector 90. When the lock arm 811 is pulled, the lock arm 811 acts like a pull tab and assists in removing the FFC 40 from the electrical connector 90. The operator finger holds 8112 further make it easier to pull the lock arm 811 and thus the FFC 40 from the electrical connector 90.

In the illustrated embodiment, the maximum angle is up to about 160 degrees. It is possible, however, to make the maximum angle about 180 degrees so that the lock arm 811 is substantially parallel to the substrate B in the open position. However, due to the decreased height of the electrical connector 90, if the lock arm 811 can be opened up to about 180 degrees, there will be little space for the operator to place their fingers f between the substrate B and the lock arm 811, which may hinder the pull tab function of the lock arm 811. Moreover, when the lock arm 811 is opened up to about 180 degrees, the operator may carelessly push down on the lock arm 811 in the direction of the substrate B, which can damage the lock arm 811. Additionally, the open position is not limited to the maximum angle position, but could include any position where engagement of the lock arm 811 with the electrical connector 90 is released.

Figure 19:
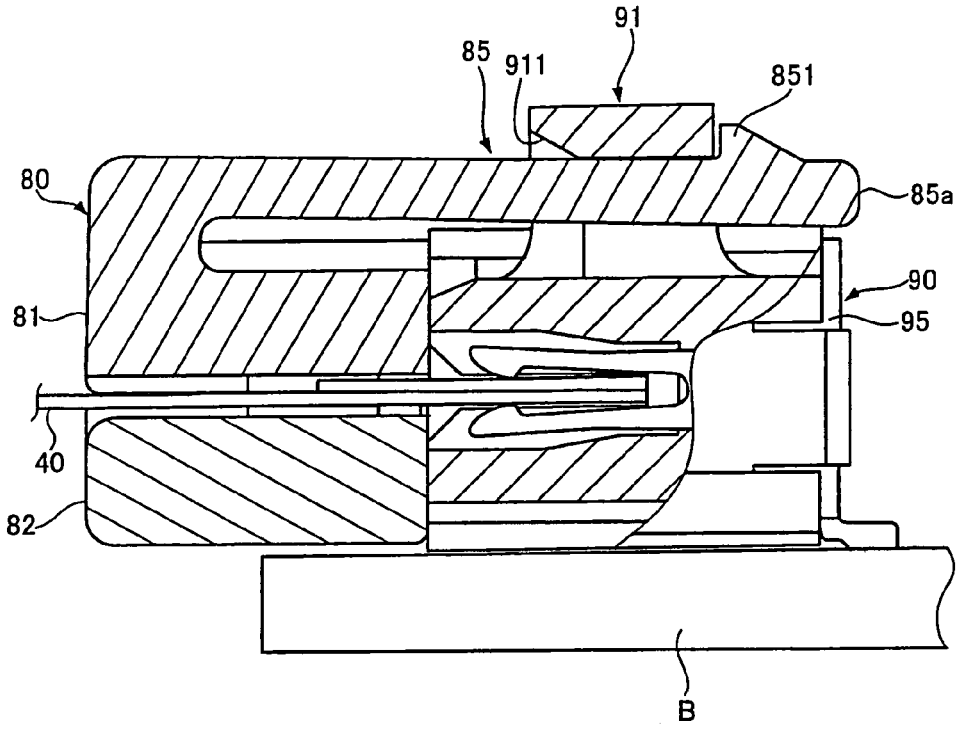
FIG. 19 is a sectional view of an FFC according to a fourth embodiment of the invention fitted with a coupler according to a fourth embodiment of the invention and completely inserted into an electrical connector according to a fourth embodiment of the invention.

FIG. 19 shows a coupler 80, an FFC 40, and an electrical connector 90 according to a fourth embodiment of the invention. Elements of the fourth embodiment will be described using some of the same reference numerals as the third embodiment and identical elements will not be described further herein. FIG. 19 shows the FFC 40 fitted with the coupler 80 completely inserted into the electrical connector 90. Unlike the coupler 80 of the third embodiment, the coupler 80 of the fourth embodiment has a resilient non-rotatable lock arm 85 in place of the rotatable lock arm 811. The lock arm 85 extends away from the coupler 80 toward a tip 41 of the FFC 40. On a tip 85*a* of the lock arm 85 is a locking claw 851 that extends away from the coupler 80. The electrical connector 90 has a main body 95 and an engagement member 91 with a tapered surface 911 that descends toward the first and second holding members 81, 82 further into the direction of insertion of the FFC 40.

When the FFC 40 fitted with the coupler 80 is partially inserted into the electrical connector 90, the tip 85*a* of the lock arm 85 abuts the engagement member 91 of the electrical connector 90. As the FFC 40 is further inserted into the electrical connector 90, the tapered surface 911 of the engagement member 91 causes the lock arm 85 to bend toward the main body 95 of the electrical connector 90. Upon completion of the insertion of the FFC 40 into the electrical connector 90, the lock arm 85 recovers by its resilience from the bent state, and the lock claw 851 engages with the engagement member 91. When the lock claw 851 engages with the engagement member 91, a click is generated. Therefore, an operator can feel when the FFC 40 is completely inserted into the electrical connector 90.

In order to remove the FFC 40 from the electrical connector 90, the tip 85*a* of the lock arm 85 is pushed down toward the first and second holding members 81, 82 and the main body 95 of the electrical connector 90. The lock arm 85 can be bent until it abuts the main body 95 of the electrical connector 90. The main body 95 thereby prevents the lock arm 85 from being broken. The lock arm 85 is also more resistant to breakage than the engagement member 313 of the electrical connector 30 of the first embodiment. Additionally, because the lock arm 85 is not formed on the electrical connector 90, which is soldered to a circuit board, if the lock arm 85 breaks, it can easily be replaced by replacing the coupler 80.

The foregoing illustrates some of the possibilities for practicing the invention. Many other embodiments are possible within the scope and spirit of the invention. For example, although the electrical connector 30, 70, 90 is described herein as being mounted on the surface of the substrate B, the electrical connector 30, 70, 90 is not limited to this type of arrangement. It is, therefore, intended that the foregoing description be regarded as illustrative rather than limiting, and that the scope of the invention is given by the appended claims together with their full range of equivalents.

What is claimed is:

1. A coupler for inserting a tip of a flexible flat cable into an electrical connector, the tip being provided with a plurality of conductors between ends thereof for electrically connecting the flexible flat cable to contacts in the electrical connector, the coupler comprising:

first and second holding members, the first and second holding members forming a gap for receiving a portion of the flexible flat cable behind the tip there between when mated with each other such that both sides of the tip are exposed; and a lock arm extending from the coupler for engaging with a corresponding engagement member on the electrical connector.

2. The coupler of claim 1, further comprising guide members extending from ends of the coupler for positioning adjacent to the conductors at ends of the flexible flat cable.

3. The coupler of claim 1, wherein the lock arm is pivotally supported on the first holding member and rotates between an open and a closed position.

4. The coupler of claim 1, wherein the first holding member has receiving apertures and the second holding member has bosses that engage the receiving apertures when the first and second holding members are mated.

5. The coupler of claim 1, wherein the first holding member has engaging grooves and the second holding member has engaging arms that engage the engaging grooves when the first and second holding members are mated.

6. The coupler of claim 1, wherein the lock arm is provided at a central portion of the coupler.

7. The coupler of claim 1, wherein the lock arm is resilient.

8. An electrical connector assembly, comprising a flexible flat cable having a tip, a plurality of conductors being provided on a section of the tip between ends thereof; and a coupler including a first holding member mated with a second holding member, the flexible flat cable being positioned between the first and second holding members, the coupler being arranged behind the tip such that both sides of the tip are exposed, the coupler having a width longer than the section of the tip provided with the conductors.

9. The electrical connector assembly of claim 8, further comprising guide members extending from ends of the coupler for guiding the tip into an electrical connector.

10. The electrical connector assembly of claim 9, wherein the guide members are positioned inward from ends of the coupler.

11. The electrical connector assembly of claim 8, further comprising a lock arm extending from the coupler that engages an electrical connector.

12. The electrical connector assembly of claim 11, wherein the lock arm is resilient.

13. The electrical connector assembly of claim 11, wherein the lock arm is pivotally supported on the first holding member and rotates between an open position where the flexible flat cable can be removed from the electrical connector and a closed position where the flexible flat cable is secured in the electrical connector.

14. The electrical connector assembly of claim 12, wherein the lock arm is substantially parallel to the flexible flat cable in the open position.

15. The electrical connector assembly of claim 8, wherein the second holding member includes bosses that extend through elongated slots in the flexible flat cable.

* * * * *